US009228741B2

(12) United States Patent
Buelow et al.

(10) Patent No.: US 9,228,741 B2
(45) Date of Patent: Jan. 5, 2016

(54) LIQUID FUEL SWIRLER

(75) Inventors: Philip E. O. Buelow, West Des Moines, IA (US); David H. Bretz, West Des Moines, IA (US); Jason Ryon, Carlisle, IA (US)

(73) Assignee: Rolls-Royce plc (GB)

( * ) Notice: Subject to any disclaimer, the term of this patent is extended or adjusted under 35 U.S.C. 154(b) by 947 days.

(21) Appl. No.: 13/368,659

(22) Filed: Feb. 8, 2012

(65) Prior Publication Data

US 2013/0200179 A1 Aug. 8, 2013

(51) Int. Cl.

| | |
|---|---|
| ***B05B 1/34*** | (2006.01) |
| ***B05B 7/10*** | (2006.01) |
| ***F02M 59/00*** | (2006.01) |
| ***B05B 1/14*** | (2006.01) |
| ***B05B 1/24*** | (2006.01) |
| ***F23D 11/38*** | (2006.01) |
| ***F23R 3/34*** | (2006.01) |

(52) U.S. Cl.

CPC ..... *F23D 11/383* (2013.01); *F23R 3/346* (2013.01)

(58) Field of Classification Search

CPC ..... F23D 11/383; F23R 3/346; B05B 1/14; B05B 1/34; B05B 1/3405; B05B 1/341; B05B 17/04

USPC ..... 239/463, 13, 399, 403–406, 553, 128, 239/533.1, 533.2; 60/740, 746, 747, 748, 60/776, 804

See application file for complete search history.

(56) References Cited

U.S. PATENT DOCUMENTS

| | | | | |
|---|---|---|---|---|
| 1,875,457 | A | 9/1932 | Hemmingsen | |
| 4,422,426 | A * | 12/1983 | Tsugekawa et al. | 123/470 |
| 5,570,580 | A | 11/1996 | Mains | |
| 6,523,350 | B1 | 2/2003 | Mancini et al. | |
| 6,547,163 | B1 | 4/2003 | Mansour et al. | |
| 6,622,488 | B2 | 9/2003 | Mansour et al. | |
| 6,672,066 | B2 | 1/2004 | Wrubel et al. | |
| 6,688,534 | B2 | 2/2004 | Bretz | 239/8 |
| 6,718,770 | B2 | 4/2004 | Laing et al. | |
| 6,755,024 | B1 * | 6/2004 | Mao et al. | 60/776 |
| 7,028,483 | B2 * | 4/2006 | Mansour et al. | 60/748 |
| 7,506,510 | B2 * | 3/2009 | Thomson | 60/740 |
| 2003/0221429 | A1 | 12/2003 | Laing et al. | 60/740 |
| 2004/0148937 | A1 | 8/2004 | Mancini | |
| 2004/0148938 | A1 | 8/2004 | Mancini et al. | |
| 2006/0059915 | A1 * | 3/2006 | Furletov et al. | 60/740 |
| 2012/0228397 | A1 | 9/2012 | Thomson | |

FOREIGN PATENT DOCUMENTS

| | | | |
|---|---|---|---|
| EP | 1750056 | A2 | 2/2007 |
| GB | 2374406 | A | 10/2002 |
| GB | 2404976 | A | 2/2005 |

* cited by examiner

*Primary Examiner* — Len Tran
*Assistant Examiner* — Steven M Cernoch
(74) *Attorney, Agent, or Firm* — Barnes & Thornburg LLP

(57) ABSTRACT

A flow directing device for imparting swirl on a fluid includes a flow directing body having an inboard surface and opposed outboard surface. A flow channel is defined in the outboard surface of the flow directing body for conducting fluids flowing through the flow directing body. The flow channel includes a channel floor and a sidewall extending from the channel floor to the outboard surface of the flow directing body. A swirl port extends from the sidewall of the flow channel though the flow directing body to the inboard surface of the flow directing body for mitigating pressure loss when discharging fluid from the flow channel.

10 Claims, 7 Drawing Sheets

Fig. 8
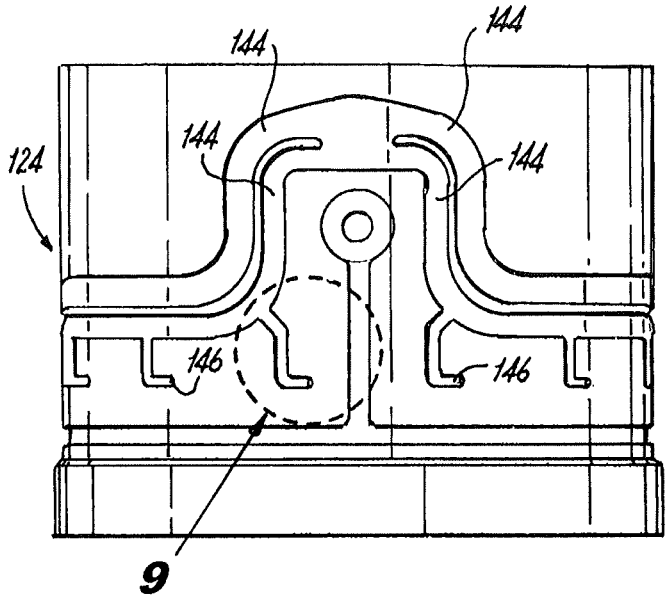
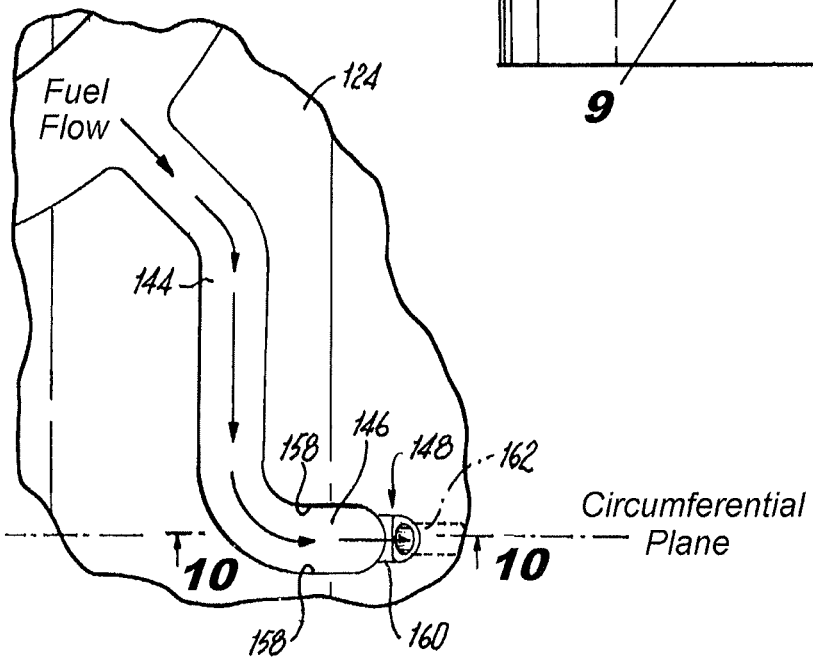
Fig. 9
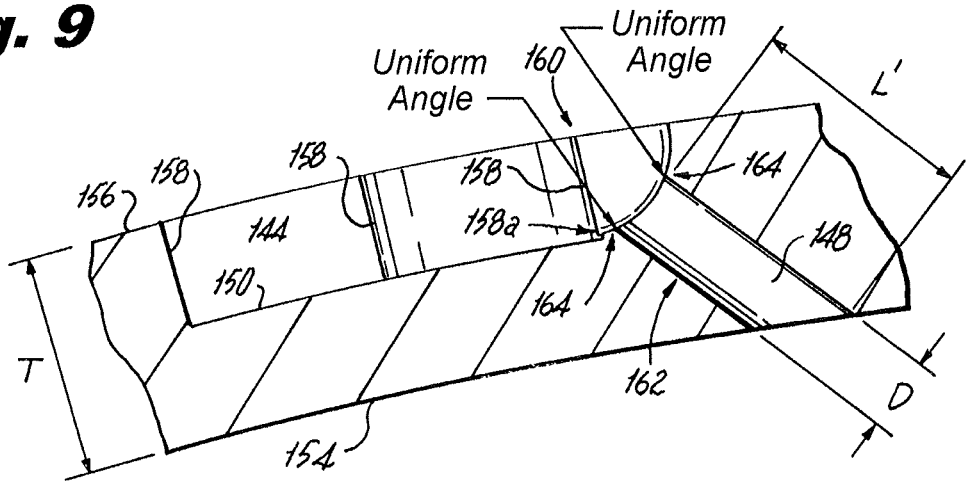
Fig. 10

LIQUID FUEL SWIRLER

BACKGROUND OF THE INVENTION

1. Field of the Invention

The present invention relates to mitigation of pressure loss such as in liquid injection, and more particularly to mitigation of swirling flow in fuel passages of fuel injectors.

2. Description of Related Art

Fuel injectors for applications such as gas turbine engines require control over the distribution of the fuel through the injector. Typically fuel is introduced through a single inlet fitting, and then distributed to a plurality of fuel ports, which can be slots or drilled holes, for presentation to a swirl chamber and/or a combustion chamber. The fluid pathway from the single inlet to the plurality of ports can take many different forms. In one example, pre-swirl distribution troughs are provided upstream of the fuel ports whereby the fuel exits the inlet fitting region through one or more passages that impart a tangential velocity component to the fuel. These distribution troughs provide a space to balance the fuel distribution prior to entering the fuel ports. An example of this type of swirler is shown and described in U.S. Pat. No. 7,506,510, which is incorporated herein in its entirety. Another example provides a first full annular region separated from a second full annular region by a restrictive full annular throat region. By taking a pressure drop through the throat feature, the flow is balanced around the circumference of the component prior to the fuel entering the ports. Another example divides the fuel from the fuel inlet region into two or more discrete fuel passages with each passage terminating with one or more fuel ports, as shown and described in commonly owned, co-pending U.S. patent application Ser. No. 12/932,958 which is incorporated by reference herein in its entirety. The ultimate extension of this concept has one fuel port for each passage.

The fuel-delivery path leading up to the port contributes to the character of the flow entering the port. For a port which breaks out on the inner or outer diameter of the fuel passage, the direction of the flow as it approaches the port typically has a strong component which is perpendicular to the axis of the port. In this situation, the flow will have a clear tendency to swirl as it enters the port, similar to the way water swirls as it flows down a drain. Unless proper control is effected on the fuel as it approaches the port, the fuel may spin in either the clockwise or counter-clockwise direction. The clockwise/counter-clockwise direction of swirl can result in different behavior of the flow through and exiting the port.

The required driving pressure needed to maintain a specified flow-rate is also affected by whether the flow is swirling or not swirling. A larger pressure-drop occurs through a hole that has a swirling flow therein, as opposed to a non-swirling flow. Therefore a swirling flow within a swirl port will require a larger driving pressure to achieve a specified flow rate, when compared to a non-swirling flow.

Such conventional methods and systems have generally been considered satisfactory for their intended purpose. However, there is still a need in the art for port geometry that allows for improved mitigation of unwanted swirl therein. There also remains a need in the art for liquid injectors incorporating such port geometry. The present invention provides a solution for these problems.

SUMMARY OF THE INVENTION

The subject invention is directed to a new and useful flow directing device for imparting swirl on a fluid. The device includes a flow directing body having an first surface, e.g., an outboard surface, and opposed second surface, e.g., an inboard surface. A flow channel is defined in the first surface of the flow directing body for conducting fluids flowing through the flow directing body. The flow channel includes a channel floor and a sidewall extending from the channel floor to the first surface of the flow directing body. A swirl port extends from the sidewall of the flow channel though the flow directing body to the second surface thereof for mitigating pressure loss when discharging fluid from the flow channel.

In certain embodiments, the sidewall of the flow channel is substantially perpendicular to the channel floor, and the swirl port extends obliquely with respect to the channel floor and sidewall for imparting swirl on a fluid flowing therethrough. The swirl port can advantageously include an antechamber defined in the sidewall of the flow channel, and a bore extending from the antechamber through the flow directing body to the second surface. The antechamber can include a spherical portion, and can extend inboard from the first surface of the flow directing body. The antechamber can have a depth from the first surface of the flow directing body that is less than that of the channel floor.

It is also contemplated that the bore of the swirl port can be cylindrical. An edge defined at the junction of the antechamber and the bore can define a substantially uniform angle between the antechamber and the bore circumferentially around the edge. The substantially uniform angle can be about 45°. The swirl port can be defined in a terminus of the flow channel. The terminus of the flow channel can be at least partially aligned with the swirl port, or can be out of alignment therewith.

The invention also provides an injector for producing an atomized spray of liquid. The injector includes an annular injector body and a first annular flow directing body mounted inboard of the injector body. The first flow directing body includes an inboard surface and opposed outboard surface. A plurality of flow channels and respective swirl ports as described above are defined in the outboard surface of the first flow directing body for conducting fluids flowing through the first flow directing body. A second annular flow directing body is mounted radially inboard of the first flow directing body. The second flow directing body includes an outboard surface with an annular swirl chamber defined therein for receiving liquid from the swirl ports of the first flow directing body to form a swirling sheet of liquid for atomization downstream of the second flow directing body. The swirl port can optionally define a longitudinal axis therethrough that forms a complex angle with radial, tangential, and axial components with respect to a main axis, for example the main axis of the annular injector body.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 8 is a plan view of an exemplary embodiment of a flow directing body constructed in accordance with the present invention, showing the terminus portions of individual fuel channels;

FIG. 9 is a plan view of a portion of the flow directing body of FIG. 8, schematically showing a flow of fuel through the channel exiting the swirl port in the sidewall of the channel;

FIG. 10 is a cross-sectional end view of a portion of the flow directing body of FIG. 9, showing the swirl port passing through the flow directing body from the channel sidewall to the inner surface of the flow directing body;

DETAILED DESCRIPTION OF THE PREFERRED EMBODIMENTS

Figure 1:
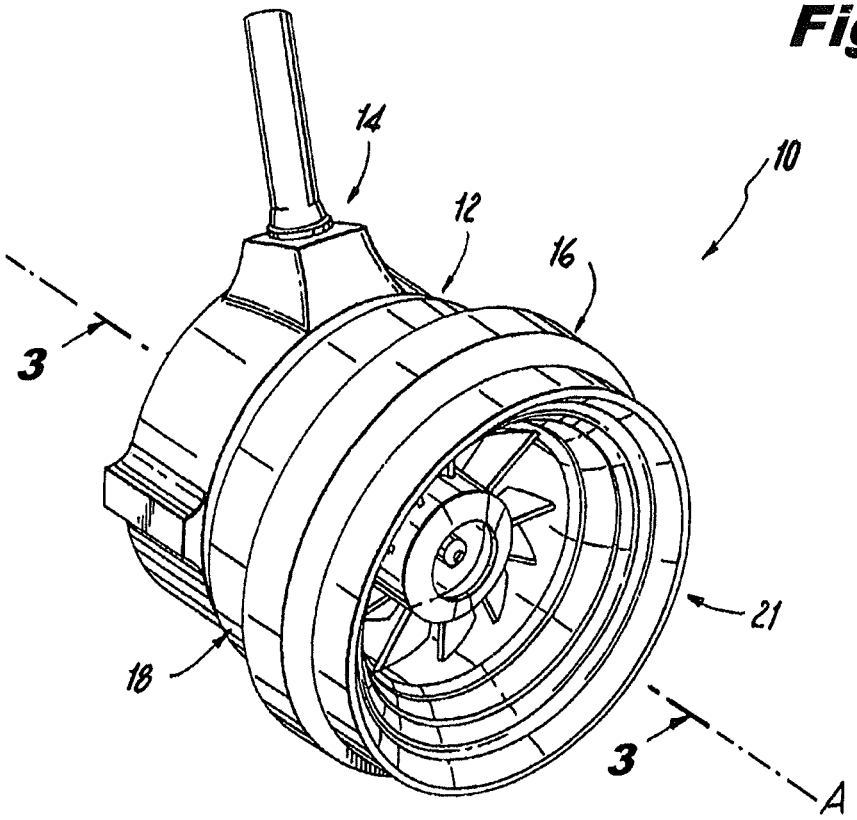
FIG. 1 is a perspective view of an exemplary embodiment of a staged fuel injector constructed in accordance with the present invention, showing the spray outlet.

Reference will now be made to the drawings wherein like reference numerals identify similar structural features or aspects of the subject invention. For purposes of explanation and illustration, and not limitation, a partial view of an exemplary embodiment of an injector in accordance with the invention is shown in FIG. 1 and is designated generally by reference character 10. Other embodiments of injectors in accordance with the invention, or aspects thereof, are provided in FIGS. 2-13, as will be described. The systems of the invention can be used to reduce variability of flow through injector ports and reduce flow-loss.

Referring now to FIG. 1, fuel injector 10 is adapted and configured for producing an atomized spray of liquid, such as for delivering fuel to the combustion chamber of a gas turbine engine. Fuel injector 10 is generally referred to as a staged fuel injector in that it includes a pilot fuel circuit, which typically operates during engine ignition and at low engine power and a main fuel circuit, which typically operates at high engine power (e.g., at take-off and cruise) and is typically staged off at lower power operation.

Figure 3:
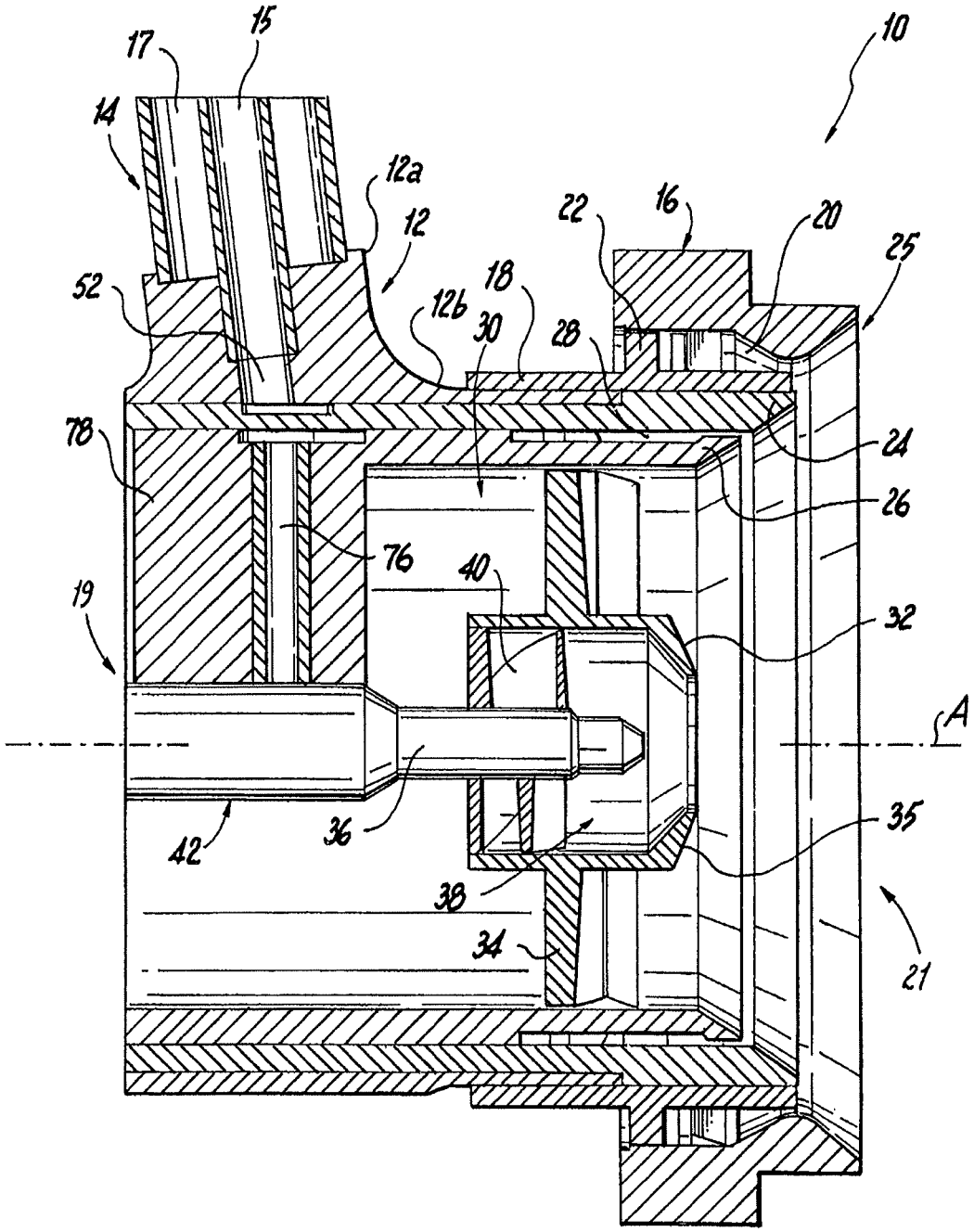
FIG. 3 is a cross-sectional side elevation view of the injector of FIG. 1, showing the fuel and air circuits for the main and pilot fuel stages.

Fuel injector 10 includes a generally annular injector body 12, which depends from an elongated feed arm 14, and defines a longitudinal axis A. In operation, main and pilot fuel flows are delivered into injector body 12 through concentric fuel feed tubes. As shown in FIG. 3, these feed tubes include an inner/main fuel feed tube 15 and an outer/pilot fuel feed tube 17 located within the feed arm 14. Although not depicted herein, it is envisioned that the fuel feed tubes could be enclosed within an elongated shroud or protective strut extending from a fuel fitting to the nozzle body.

Figure 2:
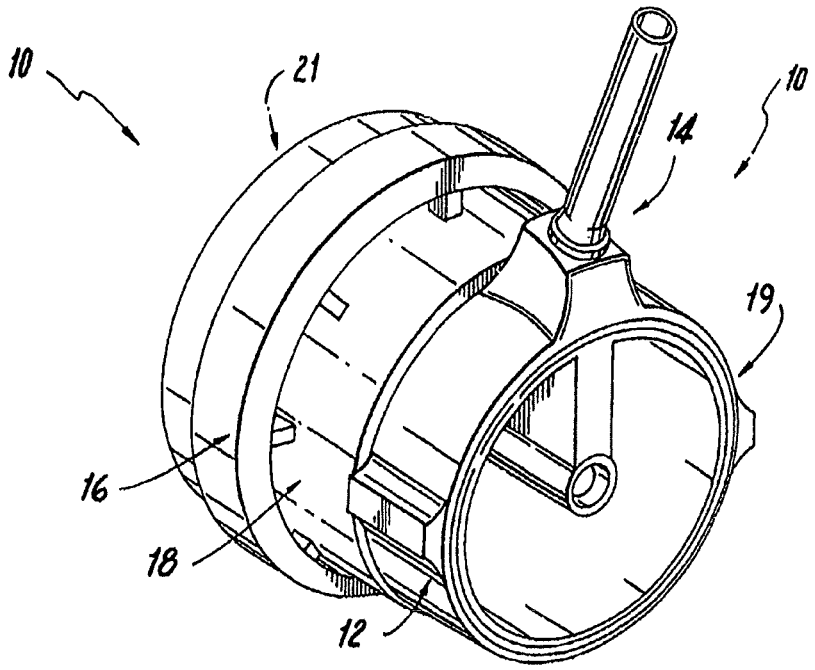
FIG. 2 is a perspective view of the injector of FIG. 1, showing the air inlet end portion of the injector.

Referring now to FIG. 2, at the same time fuel is delivered to injector body 12 through feed arm 14, pressurized combustor discharge air is directed into the inlet end 19 of injector body 12 and directed through a series of main and pilot air circuits or passages, which are shown in FIG. 3. The air flowing through the main and pilot air circuits interacts with the main and pilot fuel flows from feed arm 14. That interaction facilitates the atomization of the main and pilot fuel issued from the outlet end 21 of injector body 12 and into the combustion chamber of the gas turbine engine.

Referring now to FIG. 3, injector body 12 includes a main fuel atomizer 25 that has an outer air cap 16 and a main outer air swirler 18. A main outer air circuit 20 is defined between the outer air cap 16 and the outer air swirler 18. Swirl vanes 22 are provided within the main outer air circuit 20, depending from outer air swirler 18, to impart an angular component of swirl to the pressurized combustor air flowing therethrough.

An annular fuel prefilmer 24 is mounted inboard of injector body 12, positioned radially inward of the outer air swirler 18. An annular main fuel swirler 26 is mounted radially inward of the prefilmer 24. Prefilmer 24 has a diverging prefilming surface at the nozzle opening. As described in more detail herein below with reference to FIGS. 4 and 5, portions of the fuel circuits, including flow channels and respective swirl ports are defined in the outer diametrical surface of the prefilmer 24 for conducting fluids flowing therethrough.

With continuing reference to FIG. 3, the main fuel circuit receives fuel from the inner feed tube 15 and delivers that fuel into an annular swirl chamber 28 defined in the outboard surface of main fuel swirler 26 and located at the outlet end of the main fuel atomizer 25. Swirl chamber 28 receives liquid from swirl ports of prefilmer 24, which are described below, to form a swirling sheet of liquid for atomization downstream of prefilmer 24. The main fuel atomizer further includes a main inner air circuit 30 defined between the main fuel swirler 26 and a converging pilot air cap 32. Swirl vanes 34 are provided within main inner air circuit 30, depending from pilot air cap 32, to impart an angular component of swirl to the pressurized combustor air flowing therethrough. In operation, swirling air flowing from main outer air circuit 20 and main inner air circuit 30 impinge upon the fuel issuing from swirl chamber 28, to promote atomization of the fuel.

Injector body 12 further includes an axially located pilot fuel atomizer 35 that includes the converging pilot air cap 32 and a pilot outer air swirler 36. A pilot outer air circuit 38 is defined between pilot air cap 32 and pilot outer air swirler 36. Swirl vanes 40 are provided within pilot outer air circuit 38, depending from air swirler 36, to impart an angular component of swirl to the air flowing therethrough. A pilot fuel swirler 42, shown here by way of example, as a pressure swirl atomizer, is coaxially disposed within the pilot outer air swirler 36. The pilot fuel swirler 42 receives fuel from the pilot fuel circuit by way of the inner pilot fuel conduit 76 in support flange 78. Pilot fuel conduit 76 is oriented radially, or perpendicularly with respect to longitudinal axis A.

Injector body 12 includes a tube mounting section 12*a* and an atomizer mounting section 12*b* of reduced outer diameter. Tube mounting section 12*a* includes radially projecting mounting appendage that defines a primary fuel bowl for receiving concentric fuel tubes 15 and 17 of feed arm 14. A central main bore 52 extends from the fuel bowl for communicating with inner/main fuel tube 15 to deliver fuel to the main fuel circuit. Dual pilot fuel bores (not shown, but see, e.g., bores 54a and 54b in FIG. 6 of the U.S. Pat. No. 7,506,510, which is incorporated by reference herein in its entirety) communicate with and extend from the fuel bowl for delivering pilot/cooling fuel from outer/pilot fuel tube 17 to the pilot fuel circuit.

In the injector described in U.S. Pat. No. 7,506,510, fuel passes from a channel in the prefilmer, through a radial port passing through the prefilmer, and into a respective distribution trough. From the distribution trough, fuel must pass through angled exit slots that impart a tangential component of swirl on fuel entering the prefilming spin chamber just prior to being injected as an atomizing spray from the injector. The distribution trough, angled exit slots, and prefilming chamber are all defined in the radially outer surface of the fuel swirler, which is mounted radially inboard of the prefilmer. Thus the fuel passing from the fuel channel in the prefilmer passes in a directly radial direction into the distribution trough of the fuel swirler.

Figure 4:
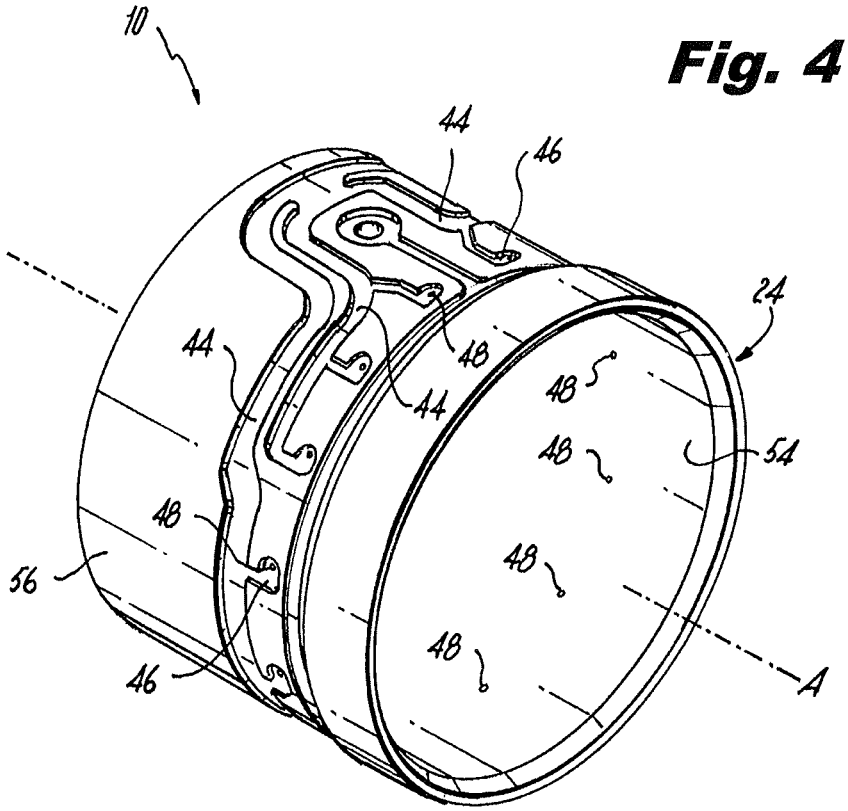
FIG. 4 is a perspective view of a portion of the injector of FIG. 1, showing the fuel channels in the outer surface of the prefilmer of the injector.
Figure 5:
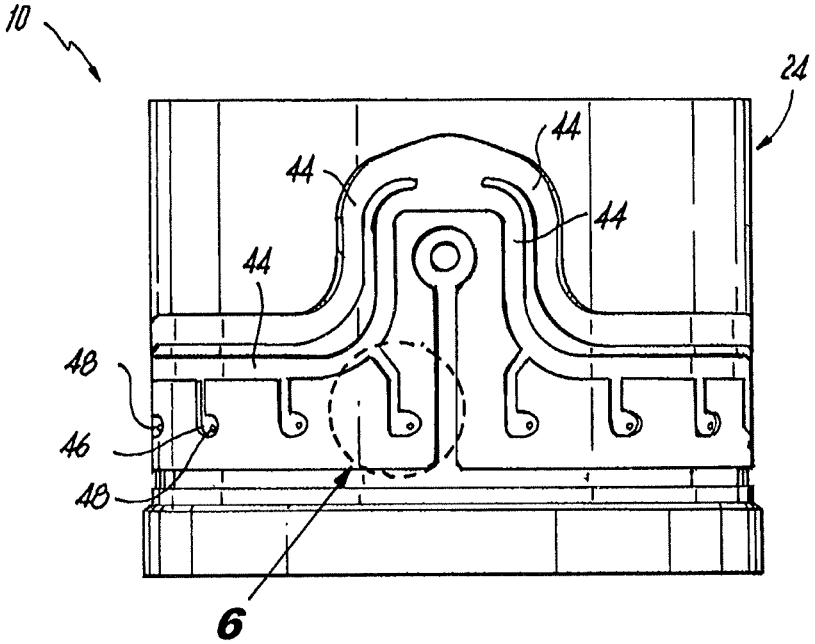
FIG. 5 is a plan view of the prefilmer of FIG. 4, showing the terminus portions of individual fuel channels.
Figure 6:
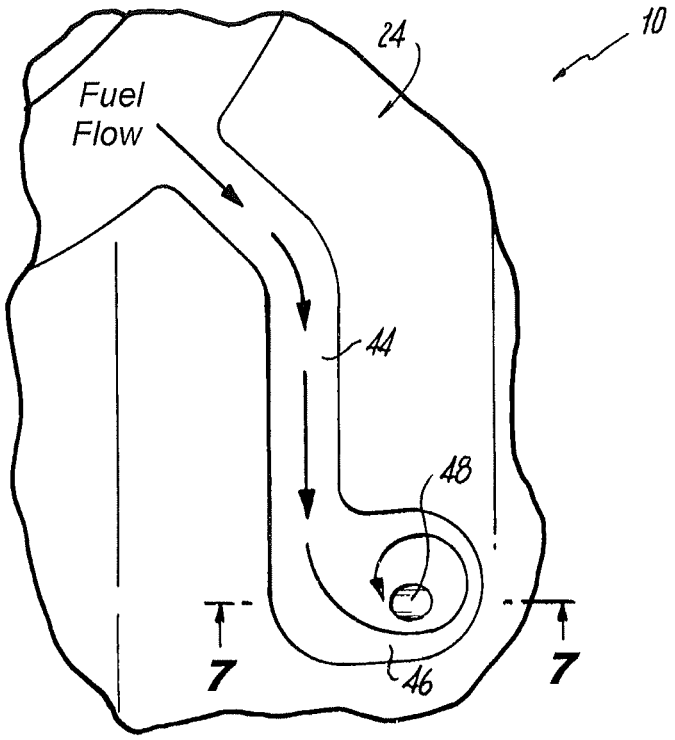
FIG. 6 is a plan view of a portion of the prefilmer of FIG. 5, schematically showing a flow of fuel through the channel exiting the fuel bore in the channel floor.
Figure 7:
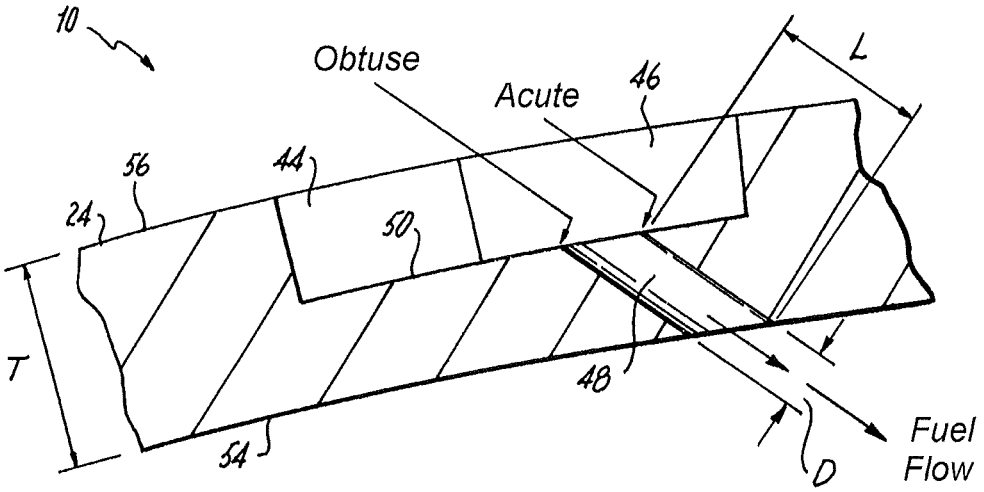
FIG. 7 is a cross-sectional end view of a portion of the prefilmer of FIG. 6, showing the swirl port passing through the prefilmer from the channel floor to the inner surface of the prefilmer.

Referring now to FIG. 4, prefilmer 24 dispenses with the distribution trough and angled exit slots described in U.S. Pat. No. 7,506,510. Instead, fuel channels 44 each have a plurality of terminus portions 46, each having a swirl port 48 that is angled tangentially with respect axis A, rather than being aligned with a radius extending from axis A. Prefilmer 24 includes an inboard surface 54 and opposed outboard surface 56, which are indicated in FIG. 7. Channels 44 are formed in outboard surface 56, and the swirl ports 48 extend from channel floor 50 through prefilmer 24 to inboard surface 54. FIG. 6 shows an enlarged view of one of the terminus portions 46 of the channel 44 indicated in FIG. 5. As indicated in FIGS. 6-7, as fuel passes through prefilmer 24 by way of swirl port 48, a tangential component is imparted on the flow direction that causes a swirling flow around the volume within swirl chamber 28, which is shown in cross-section in FIG. 3. Swirl is therefore produced in swirl chamber 28 without the need for distribution troughs. The importance of orienting swirl ports 48 in a predominantly tangential direction is to impart sufficient swirl to the fuel to enhance the mixing of the discrete fuel streams from the individual swirl ports 48 within swirl chamber 28. The enhanced mixing of the fuel streams ensures that the fuel will form a coherent sheet of liquid upon exiting swirl chamber 28, and improve the circumferential uniformity of the fuel sheet for a well distributed spray of atomized fuel.

Referring again to FIG. 6, one characteristic of the swirl port configuration in prefilmer 24 is the tendency for a swirling flow to form within the terminus portion 46, much as in the drain-type swirl effect described above. This swirling flow entering swirl port 48 is indicated schematically by the flow arrows of FIG. 6. When it forms, this type of swirl raises the pressure drop and reduces the flow number for the swirl port 48. In most applications it is therefore desirable to mitigate this type of swirl.

Additionally, as indicted in FIG. 7, due to the oblique angle of swirl port 48 relative to the floor 50 of channel 44, a portion of the entrance into swirl port 48 forms an acute angle with floor 50, and a portion forms an obtuse angle therewith. Due to process variation, the characteristics of this entrance can vary significantly from one swirl port 48 to another around the circumference of prefilmer 24. The acute portions of the entrances of swirl ports 48 are particularly susceptible to process variation, which can for example, lead to the entrance flow areas varying significantly from one swirl port 48 to another in the same prefilmer 24. The result is that process variation causes significant differences in flow from swirl port 48 to swirl port 48 around a given prefilmer 24, which can lead to a detrimental uneven flow pattern for injector 10.

Referring now to FIG. 8, an exemplary embodiment of a flow directing body 124 is shown, which can replace prefilmer 24 in injector 10 described above to addresses the process variation and unwanted swirl issues described above. Flow directing body 124 includes channels 144 with terminus portions 146 much as described above with respect to prefilmer 24. Unlike swirl ports 48 in prefilmer 24 described above, FIGS. 9-10 show that swirl ports 148 extend from channel sidewall 158 rather than from channel floor 150. Sidewall 158 extends perpendicularly from the channel floor 150 to outboard surface 156 of flow directing body 124, although any other suitable sidewall angle can be used without departing from the scope of the invention. Swirl ports 148 extend from their respective sidewall 158 through the thickness of flow directing body 124 to the inboard surface 154 thereof for mitigating pressure loss when discharging fluid from flow channels 144. Swirl ports 148 extend obliquely with relative to their respective channel floor 150 and sidewall 158 for imparting swirl on a fluid flowing therethrough.

Referring now to FIG. 10, swirl port 148 includes an antechamber 160 defined in sidewall 158, and a bore 162 extending from antechamber 160 through flow directing body 124 to inboard surface 154. Antechamber 160 includes a spherical portion and extends in an inboard direction from outboard surface 156. The depth of antechamber 160 from outboard surface 156 is less than that of the channel floor 150, i.e., there is a portion 158*a* of sidewall 158 between the deepest extent of antechamber 160 and channel floor 150. However, it is contemplated that the depth of antechamber 160 can also be equal to or greater than the depth of channel floor 150 without departing from the spirit and scope of the invention.

With continued reference to FIG. 10, bore 162 of swirl port 148 is cylindrical, although any suitable shape can be used without departing from the scope of the invention, and an edge 164 is defined at the junction of antechamber 160 and bore 162. Edge 164 defines a substantially uniform angle between antechamber 160 and bore 162 circumferentially around edge 164 because antechamber 160 and bore 162 are centered with respect to one another. This uniform angle is about 45°, however any other suitable angle can be formed depending on the relative sizes of antechamber 160 and bore 162. Edge 164 can optionally be chamfered or rounded as needed from application to application, which can be accomplished, for example, by direct laser to metal sintering. One aspect of antechamber 160 is to serve to more gradually accelerate the flow into bore 162, leading to increased flowrate for a given driving pressure.

Moreover, antechamber 160 and bore 162 can be off-center with respect to one another without departing from the spirit and scope of the invention. This arrangement of antechamber 160 and bore 162 reduces or eliminates the uneven flow issues described above arising from process variation. For example, if a deburring process is used to remove burs from the openings of bores 162, the openings of bores 162 are significantly less likely to be deformed due to the retained material compared to the acute portions of the edge at the entrance of swirl ports 48 described above. This makes bores 162 less sensitive to variations in the process than are swirl ports 48 described above, since the openings of bores 162 have a substantially uniform edge angle. In other words, the opening of bores 162 is a lower flow loss region than the openings of swirl ports 48 described above, and therefore bores 162 are less sensitive to post processing and other process variations. This also provides more even flow patternation repeatability in manufacturing.

The swirl port configuration shown in FIGS. 8-10 addresses the swirling drain effect described above, since swirl port 148 has its opening at sidewall 158 of channel 144, rather than in channel floor 150. By placing at least a portion of the opening of swirl port 148 in sidewall 158, the primary direction of the flow leading up to the entrance of swirl port 148 is more closely aligned with the axis of swirl port 148. There is thus a significantly diminished tendency for perpendicular flow perturbations to set up swirling flow conditions at the opening into swirl port 148. The tendency is instead, for fluids to flow straight from terminus portion 146 into swirl port 148 as indicated schematically by flow arrows in FIG. 9. In short, undesirable swirl at the entrance to and within swirl ports 148 is mitigated or eliminated by having the opening of swirl ports 148 in their respective channel sidewalls 158.

Another benefit of the swirl port configuration in flow directing body 124 is an increased swirl strength in swirl chamber 28 (shown in FIG. 3) provided by swirl ports 148 compared to swirl ports 48 of prefilmer 24. Since swirl ports 148 open from sidewalls 158 rather than from channel floor 150, swirl ports are longer for a given wall thickness than are swirl ports 48, which only extend from channel floor 50. Comparing FIG. 7 and FIG. 10, for a given wall thickness T and bore diameter D, bore 162 has a longer length L' than the length L of swirl port 48. Therefore, the length to diameter ratio (L'/D) for flow directing body 124 in FIG. 10 is greater than the length to diameter ratio (L/D) for prefilmer 24 in FIG. 7. Generally, the greater the L/D ratio for radial swirler ports, the greater the flow direction conforms to the angle of each swirl port, and the stronger the swirl within the swirl chamber generated by the swirl ports. Therefore, the extra length provided by extending swirl ports 148 provides for improved swirl in swirl chamber 28 (shown in FIG. 3).

It should be noted that there are two different types of swirl discussed herein. The preceding paragraph discusses desirable swirl, namely the swirl generated in swirl chamber 28 for atomizing the liquid injected from injector 10. The swirl within terminus portions 46 and swirl ports 48 from the drain-type swirl effect described above is considered generally undesirable because of its negative impact on pressure drop and flow number. Flow directing body 124 improves the desirable swirl in swirl chamber 28 and mitigates or eliminates the undesirable swirl in the channel terminus and swirl ports 148 compared to prefilmer 24.

Figure 11:
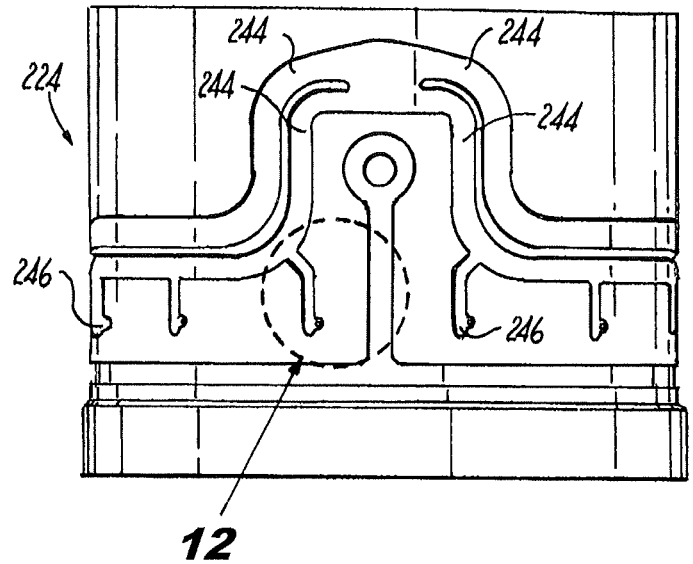
FIG. 11 is a plan view of another exemplary embodiment of a flow directing body constructed in accordance with the present invention, showing the terminus portions of individual fuel channels.

As viewed in the plan view of FIG. 9, the terminus of the flow channel 144 is aligned with the direction of swirl port 148 relative to the plane of the circumference of flow directing body 124 indicated in FIG. 9. In other words, swirl port 148 defines a longitudinal axis therethrough that is in the circumferential plane bisecting in the terminus of channel 144 and normal to channel floor 150. It is also contemplated that the terminus and swirl port can be can be out of alignment with respect to one another and at any suitable angle. For example, FIG. 11 shows an embodiment of flow directing body 224 with channels 244 each having a plurality of terminus portions 246 much as described above. However, in FIG. 12 it is apparent that as viewed in plan view, swirl port 248 is aligned with the circumferential plane indicated, while the terminus of channel 244 is generally aligned with the axial direction, i.e., substantially perpendicular to the circumferential plane of swirl port 248. Thus, as needed on a per application basis, channels and swirl ports can be configured at any suitable angle with respect to one another without departing from the spirit and scope of the invention. As shown in FIG. 13, swirl ports 248 open from sidewalls 258 of channels 244, as described above with respect to swirl ports 148.

Figure 12:
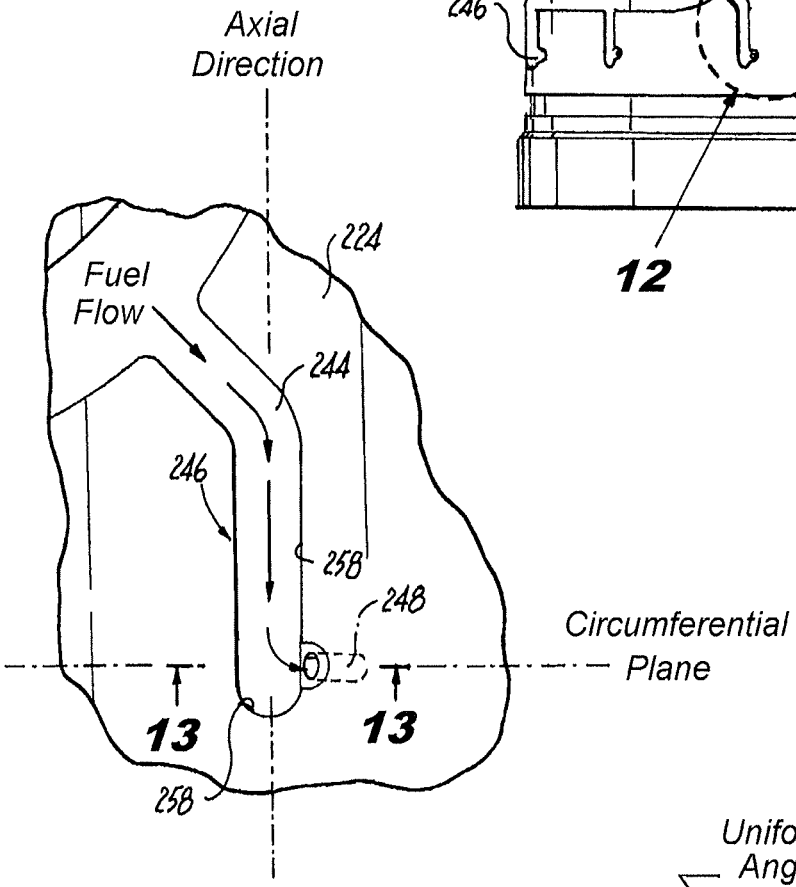
FIG. 12 is a plan view of a portion of the flow directing body of FIG. 11, schematically showing a flow of fuel through the channel exiting the swirl port in the sidewall of the channel, where the axis of the bore is not aligned with the terminus portion of the channel.
Figure 13:
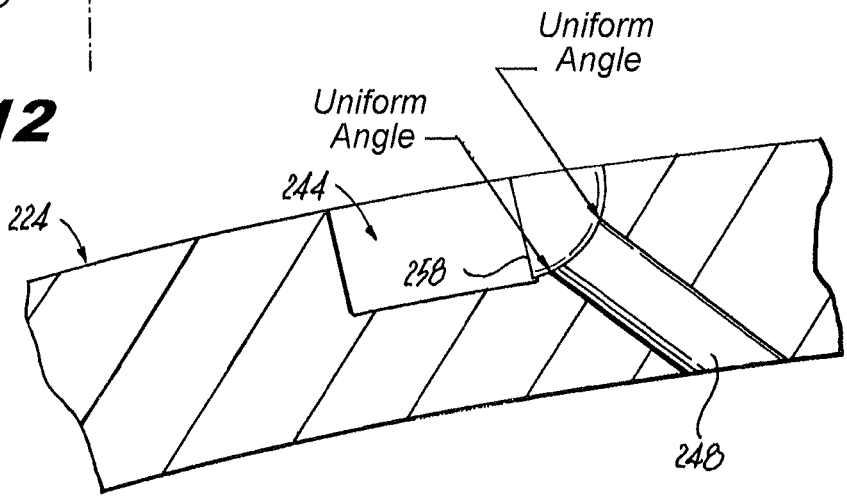
FIG. 13 is a cross-sectional end view of a portion of the flow directing body of FIG. 12, showing the swirl port passing through the flow directing body from the channel sidewall to the inner surface of the flow directing body.
Figure 14:
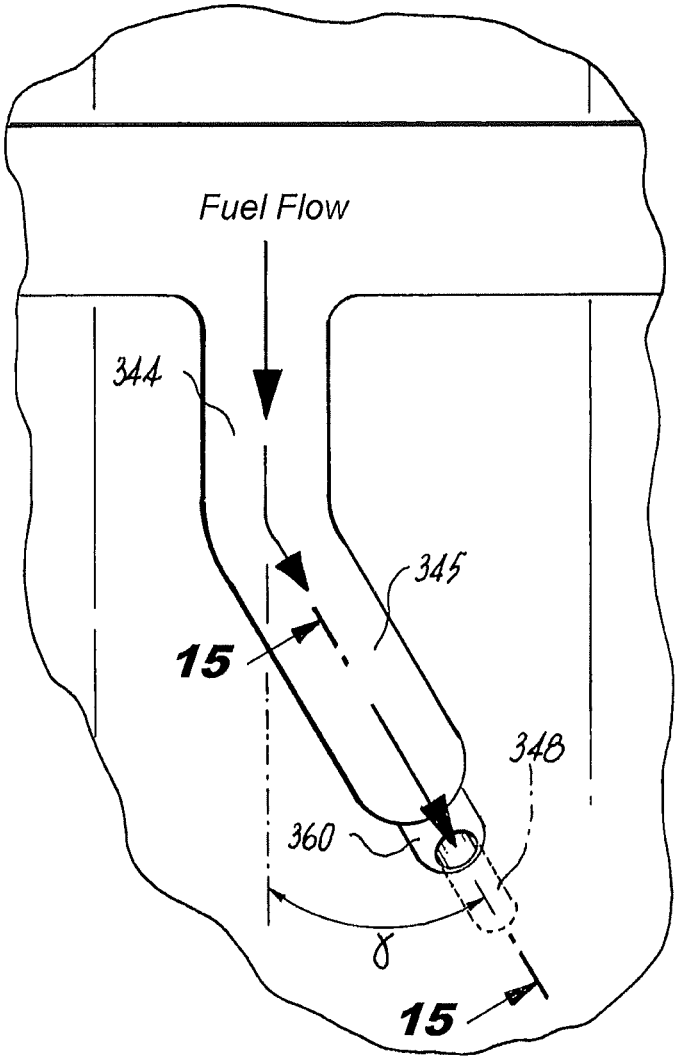
FIG. 14 is a plan view of another exemplary embodiment of a terminus portion of a flow channel and swirl port constructed in accordance with the present invention, showing the swirl port and terminus portion of the flow channel axially aligned as viewed in plan view, wherein the swirl port has a complex angle including axial, radial, and tangential components.
Figure 15:
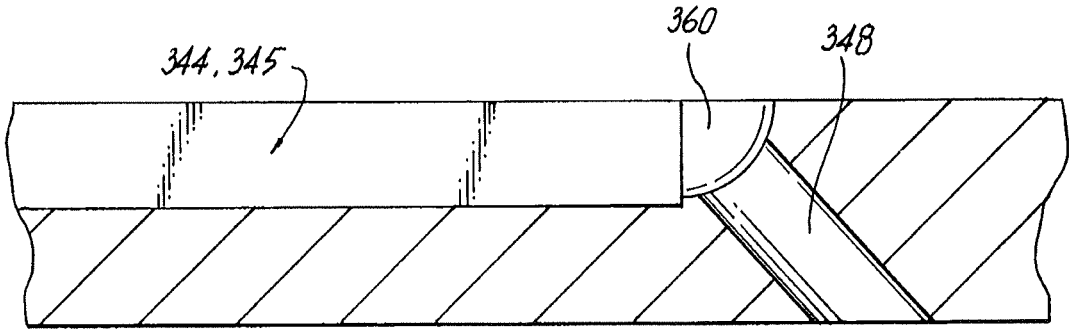
FIG. 15 is a cross-sectional elevation view of the terminus portion of the flow channel of FIG. 14, showing the radial and axial components of the complex swirl port angle as viewed at the cross-section indicated in FIG. 14.

With reference now to FIGS. 14 and 15, while FIGS. 9 and 12 each show swirl ports perpendicular to the axial direction, swirl ports with an axial angle component, i.e., not perpendicular to the axial direction, can be used without departing from the spirit and scope of the invention. In general, tangentially oriented swirl ports as described above provide swirl and mixing to produce a substantially uniform sheet of spray from an injector outlet. In certain applications, it can be desirable to instead produce more of a discrete jet spray issuing from each swirl port. In such applications, the swirl port angle can be a complex angle, meaning that in addition to the radial and tangential angle components of the swirl ports described above, swirl port 348 in FIGS. 14 and 15 has an axial component as well, which is identified in FIG. 14. Fuel channel 344 has a terminus portion 345 that is aligned with the axial component $\gamma$ of the swirl port angle, to provide benefits similar to those described above with respect to FIG. 9. As shown in FIG. 15, swirl port 248 extends from an antechamber 360 in the sidewall of channel 344 as described above.

Any suitable fabrication techniques can be used to form the flow directing body and other injector components described above. If conventional machining techniques are used, forming the antechamber with a ball nose end mill, for example, before forming the bore of a swirl port provides the advantage of preparing the work piece for easier formation of the bore, for example, by forming a spot face for a drill forming the bore. It is also contemplated that some or all of the injector components described above can be formed as an integral injector component by additive manufacturing techniques such as direct metal laser sintering. Those skilled in the art will readily appreciate that these techniques are exemplary only, and that any other suitable fabrication or manufacturing techniques can be used without departing from the spirit and scope of the invention.

While the swirl ports described above have been shown formed in the corresponding channel floor or channel sidewall, those skilled in the art will readily appreciate that placing at least a portion of the entrance to the swirl port in the sidewall provides benefits. For example, it is also possible to form a swirl port in a corner of a channel between the channel floor and sidewall. Moreover, while some of the examples above included antechambers in the swirl ports, it is also contemplated that antechambers can be included or excluded from any suitable swirl port configuration without departing from the spirit and scope of the invention.

While shown and described in the exemplary context of fuel injection, those skilled in the art will readily appreciate that the methods and systems of the invention can be used with any suitable fluid system without departing from the spirit and scope of the invention. Also, the exemplary embodiments described above convey fuel from a radially outboard component to a radially inboard component, e.g., through bores 162. However those skilled in the art will readily appreciate that the advantages described above can also be attained for flows from radially inboard components to radially outboard components without departing from the spirit and scope of the invention. Moreover, while described herein in the exemplary context of flow through bores in annular injector components, those skilled in the art will readily appreciate that flow through bores in any suitable non-annular components can similarly be improved without departing from the spirit and scope of the invention.

The methods and systems of the present invention, as described above and shown in the drawings, provide for injectors with superior properties including elimination of the need for traditional injector features such as distribution troughs upstream of metering slots. Other advantages include improved swirl strength for atomization, mitigation of unwanted internal swirl for improved pressure drop and flow number, and reduced process variation sensitivity for more uniform flow patternation.

While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An injector for producing an atomized spray of liquid comprising: a) an annular injector body; b) a first annular flow directing body mounted inboard of the injector body, the first flow directing body including an inboard surface and opposed outboard surface, wherein a plurality of flow channels are defined in the outboard surface of the first flow directing body for conducting fluids flowing through the first flow directing body, wherein each flow channel includes a channel floor spaced apart from the outboard surface and a sidewall extending from the channel floor to the outboard surface of the first flow directing body, and wherein a swirl port extends through the sidewall of each flow channel and though the first flow directing body to the inboard surface thereof; and c) a second annular flow directing body mounted radially inboard of the first flow directing body and including an outboard surface with an annular swirl chamber defined therein for receiving liquid from the swirl ports of the first flow directing body to form a swirling sheet of liquid for atomization downstream of the second flow directing body.

2. An injector as recited in claim 1, wherein the sidewall of each flow channel is substantially perpendicular to the respective channel floor, and wherein the respective swirl port extends obliquely with respect to the channel floor and sidewall for imparting swirl on a fluid flowing therethrough.

3. An injector as recited in claim 1, wherein each swirl port includes an antechamber defined in the sidewall of the respective flow channel, and a bore extending from the antechamber through the first flow directing body to the inboard surface thereof.

4. An injector as recited in claim 3, wherein each antechamber includes a spherical portion.

5. An injector as recited in claim 3, wherein each antechamber extends inboard from the outboard surface of the first flow directing body and has a depth from the outboard surface of the first flow directing body that is less than that of the respective channel floor.

6. An injector as recited in claim 3, wherein the bore of each swirl port is cylindrical and wherein an edge is defined at the junction of the respective antechamber and bore that defines a substantially uniform angle between the antechamber and the bore circumferentially around the edge.

7. An injector as recited in claim 6, wherein the substantially uniform angle is about 45.degree.

8. An injector as recited in claim 1, wherein each swirl port is defined in a terminus of the respective flow channel, and wherein each swirl port defines a longitudinal axis therethrough that is in plane with a plane bisecting the terminus of the respective flow channel normal to the respective channel floor.

9. An injector as recited in claim 1, wherein each swirl port defines a longitudinal axis therethrough that is out of plane with a plane bisecting a terminus of the respective flow channel normal to the respective channel floor.

10. An injector as recited in claim 1, wherein each swirl port defines a longitudinal axis therethrough that forms a complex angle with radial, tangential, and axial components with respect to a main axis of the annular injector body.

* * * * *